US011123594B2

(12) United States Patent
Anderson

(10) Patent No.: US 11,123,594 B2
(45) Date of Patent: Sep. 21, 2021

(54) WEIGHTLIFTING SYSTEM FOR HANGING BAND TECHNIQUE

(71) Applicant: Karl Anderson, Glendora, CA (US)

(72) Inventor: Karl Anderson, Glendora, CA (US)

( * ) Notice: Subject to any disclaimer, the term of this patent is extended or adjusted under 35 U.S.C. 154(b) by 10 days.

(21) Appl. No.: 16/776,493

(22) Filed: Jan. 29, 2020

(65) Prior Publication Data

US 2020/0238126 A1 Jul. 30, 2020

Related U.S. Application Data

(60) Provisional application No. 62/798,363, filed on Jan. 29, 2019.

(51) Int. Cl.

| | |
|---|---|
| ***A63B 21/072*** | (2006.01) |
| ***A63B 21/055*** | (2006.01) |
| ***A63B 21/04*** | (2006.01) |
| ***A63B 21/062*** | (2006.01) |

(Continued)

(52) U.S. Cl.

CPC ..... *A63B 21/0728* (2013.01); *A63B 21/0407* (2013.01); *A63B 21/0557* (2013.01); *A63B 21/062* (2013.01); *A63B 21/075* (2013.01); *A63B 21/078* (2013.01); *A63B 2225/09* (2013.01)

(58) Field of Classification Search

CPC ... A63B 21/00058–00065; A63B 21/04–0407; A63B 21/0442; A63B 21/055–0557; A63B 21/072–075; A63B 21/0728; A63B 21/078; A63B 21/08; A63B 21/062; A63B 2225/09; A63B 2209/00

See application file for complete search history.

(56) References Cited

U.S. PATENT DOCUMENTS 2,470,815 A * 5/1949 Roosevelt ..... A63B 21/0728 482/106

3,904,198 A * 9/1975 Jones ..... A63B 21/0728 482/106

(Continued)

OTHER PUBLICATIONS

Seedman, Joel, "The Craziest Training Method", published Aug. 31, 2015 on T Nation, 12 pages, retrieved from the Internet: https://www.t-nation.com/training/the-craziest-training-method/ (Year: 2015).*

*Primary Examiner* — Megan Anderson
*Assistant Examiner* — Kathleen Vermillera

(57) ABSTRACT

A weightlifting system for hanging band technique is used to enable barbell-based strength training with a unique weight deployment that provides an advantageous muscular stimulus. The system is also configured to facilitate weight loading onto a barbell sleeve for workouts. The system includes a plurality of suspended weights. The plurality of suspended weights is a set of heavy plates that hang to connect to a barbell to enable performance of barbell exercises. Each of the plurality of suspended weights includes a length-adjustable elastic band, a roller, a U-shaped bracket, and a weight assembly. The length-adjustable elastic band enables the desirable oscillations and unbalance that provides the necessary muscular stimulation. The roller rotates relative to the U-shaped bracket. The U-shaped bracket supports both the roller and the weight of the weight assembly. The weight assembly provides the gravitational resistance necessary for assisting in exercises.

9 Claims, 8 Drawing Sheets

(51) Int. Cl.
*A63B 21/078* (2006.01)
*A63B 21/075* (2006.01)

(56) References Cited

U.S. PATENT DOCUMENTS 4,188,029 A * 2/1980 Brower ..... A63B 21/154 248/636
4,252,316 A * 2/1981 Price ..... A63B 21/0728 482/106
4,360,198 A * 11/1982 Waulters ..... A63B 21/078 482/106
4,598,908 A * 7/1986 Morgan ..... A63B 21/0724 482/104
4,890,831 A * 1/1990 Craig ..... A63B 21/0724 482/104
5,029,849 A * 7/1991 Nurkowski ..... A63B 21/072 482/106
5,257,964 A * 11/1993 Petters ..... A63B 21/0724 403/377
5,891,004 A * 4/1999 Berry ..... A63B 21/04 482/129
5,984,843 A * 11/1999 Morton ..... A63B 21/0724 482/104
7,789,814 B1 * 9/2010 Xu ..... A63B 21/0728 482/107
8,506,460 B2 * 8/2013 Seitzer ..... A63B 21/065 482/106
9,381,393 B1 * 7/2016 Gonzalez ..... A63B 21/0783
9,504,869 B2 * 11/2016 Gavigan ..... A63B 21/0724
2004/0082442 A1 * 4/2004 Beedy ..... A63B 21/0004 482/93
2008/0051262 A1 * 2/2008 Striar ..... A63B 21/06 482/93
2012/0178595 A1 * 7/2012 Simpson-Weber ..... A63B 7/00 482/92
2013/0274074 A1 * 10/2013 Ghandour ..... A63B 21/4035 482/93
2017/0239508 A1 * 8/2017 Fairchild ..... A63B 23/0405
2018/0290007 A1 * 10/2018 Vorozilchak ..... A63B 21/0726
2019/0118026 A1 * 4/2019 D'Alesio ..... A63B 21/0557
2020/0023225 A1 * 1/2020 Sands ..... A63B 21/0609
2020/0087119 A1 * 3/2020 Friessen ..... A63B 21/072

* cited by examiner

WEIGHTLIFTING SYSTEM FOR HANGING BAND TECHNIQUE

The current application claims a priority to the U.S. Provisional Patent application Ser. No. 62/798,363 filed on Jan. 29, 2019.

FIELD OF THE INVENTION

The present invention relates generally to an exercise equipment system for weight lift training. More specifically, the weightlifting system for hanging band technique provides a simpler, easier and efficient way to load and unload an exercising bar used in the Hanging Band Technique (HBT). The HBT is done using a barbell with weights hanging from bands on each side.

BACKGROUND OF THE INVENTION

Among the many common goals of individuals today is to maintain a level of health and fitness conducive to attaining other goals. People are always looking for novel and varied ways to exercise their muscles, especially in order to achieve muscular growth and balance. From home workout equipment to gym memberships, individuals are spending time and money so that they can effectively exercise and experience whatever type of progress desired. Especially popular among strength exercises are barbell exercises. By adding heavy weights to either side of a rigid bar and reclining onto a bench with the bar above, the user may perform a bench press that will provide muscular stimulation to the user's arms, shoulders, and chest muscles. Similar compound movements, such as the squat and overhead press, are also capable of stimulating large muscular groups, thereby affecting large physical change.

Unfortunately, there are few solutions that allow a user to adequately challenge core and stabilizing muscles while performing these movements. While high intensity training is possible with standard weight sets, the user risks muscular fatigue due to repetitive cyclical usage of similar muscular groups. While proper programming and pacing can address fatigue, such pacing does not address the comparatively undertrained surrounding muscles that are not active in a standard bench press, squat, or other exercise. What is needed is a mechanism for providing the user with an alternative stimulus during exercises, thus enabling activation of muscles which may typically become under stimulated during standard exercises. Further desirable is a device which facilitates the addition of weights to the barbell.

The present invention addresses these issues. The weightlifting system for hanging band technique allows the user to load and unload weights on a bar more efficiently and safely. Elastic bands allow sets of weights to hang from the sleeves of the barbell, thus providing an oscillating and swinging stimulus that increases the challenge of lifting the weight. The present invention has two exemplary embodiments: the first embodiment is an exercising kit in which the band weight system and the bar catch system comes together. The second embodiment is a rack system where the customers can use their own weights or just use the weights of the present invention. The weights of the present invention are color-coded in order to enable the user to visually identify the chosen weights and to enable identification of the elastic strength of the elastic bands. This matching improves kinetic performance, repeatability, and standardization of exercises, providing optimal length stretching of the elastic band. The increased band strength is for safety and stability of the present invention in dynamic situations. The present invention also includes a weight catch system, upon which various weights may rest between exercise sets. Overall, the present invention is a complete system for weight trainers which provides the user with an efficient, safe, easy and simple mechanism for performing strength exercises.

DETAILED DESCRIPTION OF THE INVENTION

All illustrations of the drawings are for the purpose of describing selected versions of the present invention and are not intended to limit the scope of the present invention.

Figure 1:
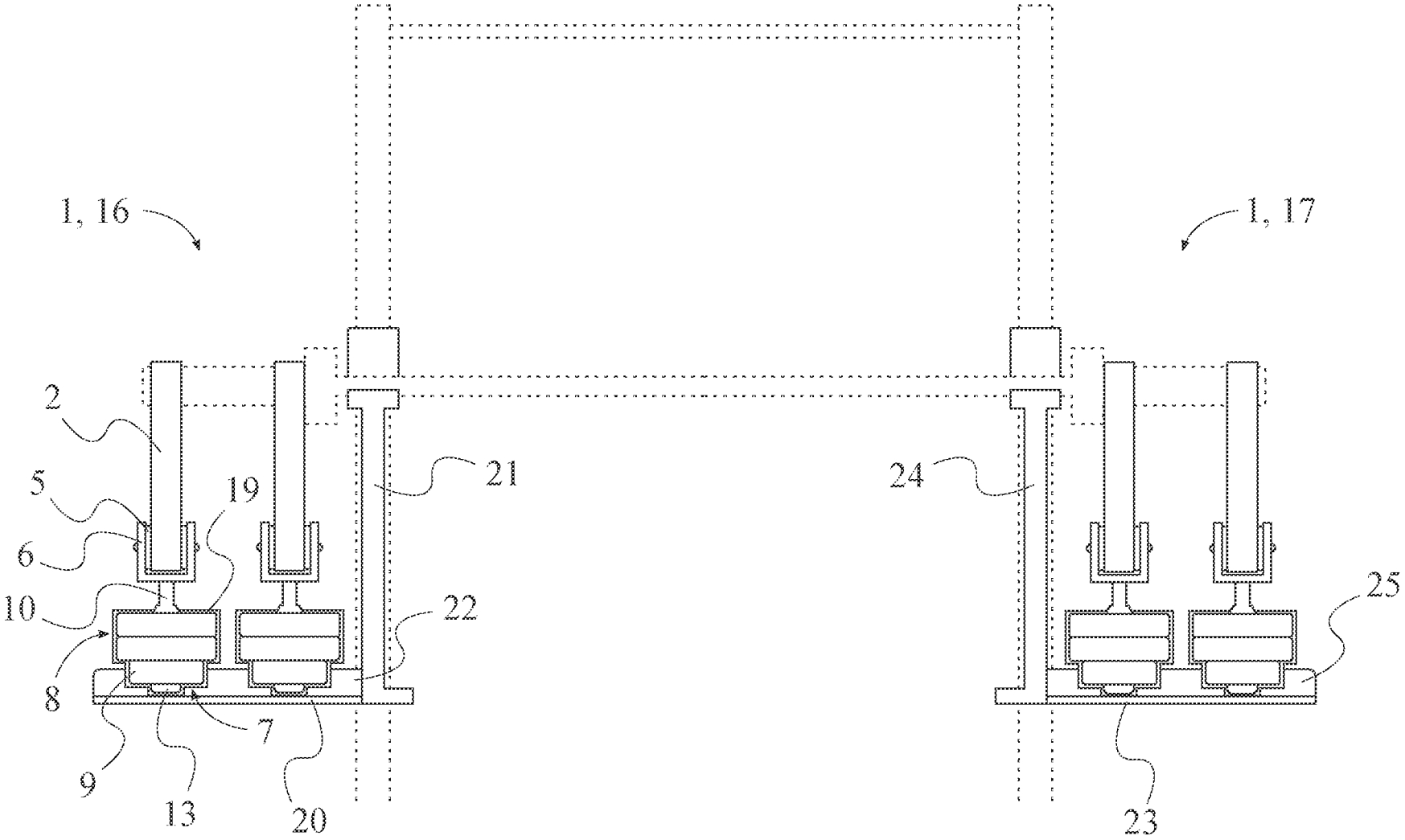
FIG. 1 is a schematic diagram illustrating a front view of the present invention.

The present invention is a weightlifting system for hanging band technique that is used to enable barbell-based strength training with a unique weight deployment that provides an advantageous muscular stimulus. The present invention is also configured to facilitate weight loading onto a barbell sleeve for workouts. A preferred embodiment of the present invention comprises a plurality of suspended weights 1. The plurality of suspended weights 1 is a set of heavy plates and weighted units that can hang to connect to a barbell and to consequently enable performance of barbell exercises, as represented by FIG. 1. Each of the plurality of suspended weights 1 comprises a length-adjustable elastic band 2, a roller 5, a U-shaped bracket 6, and a weight assembly 7. The length-adjustable elastic band 2 relates to a flexible elastic unit which enables the desirable oscillations and unbalance that provides the necessary muscular stimulation. The roller 5 is a cylindrical unit which rotates relative to the U-shaped bracket 6. The U-shaped bracket 6 relates to a retaining device capable of both supporting the roller 5 and supporting the weight of the weight assembly 7. The weight assembly 7 relates to a set of heavy plates or other weighted objects capable of providing the gravitational resistance necessary for assisting in exercises.

Figure 3:
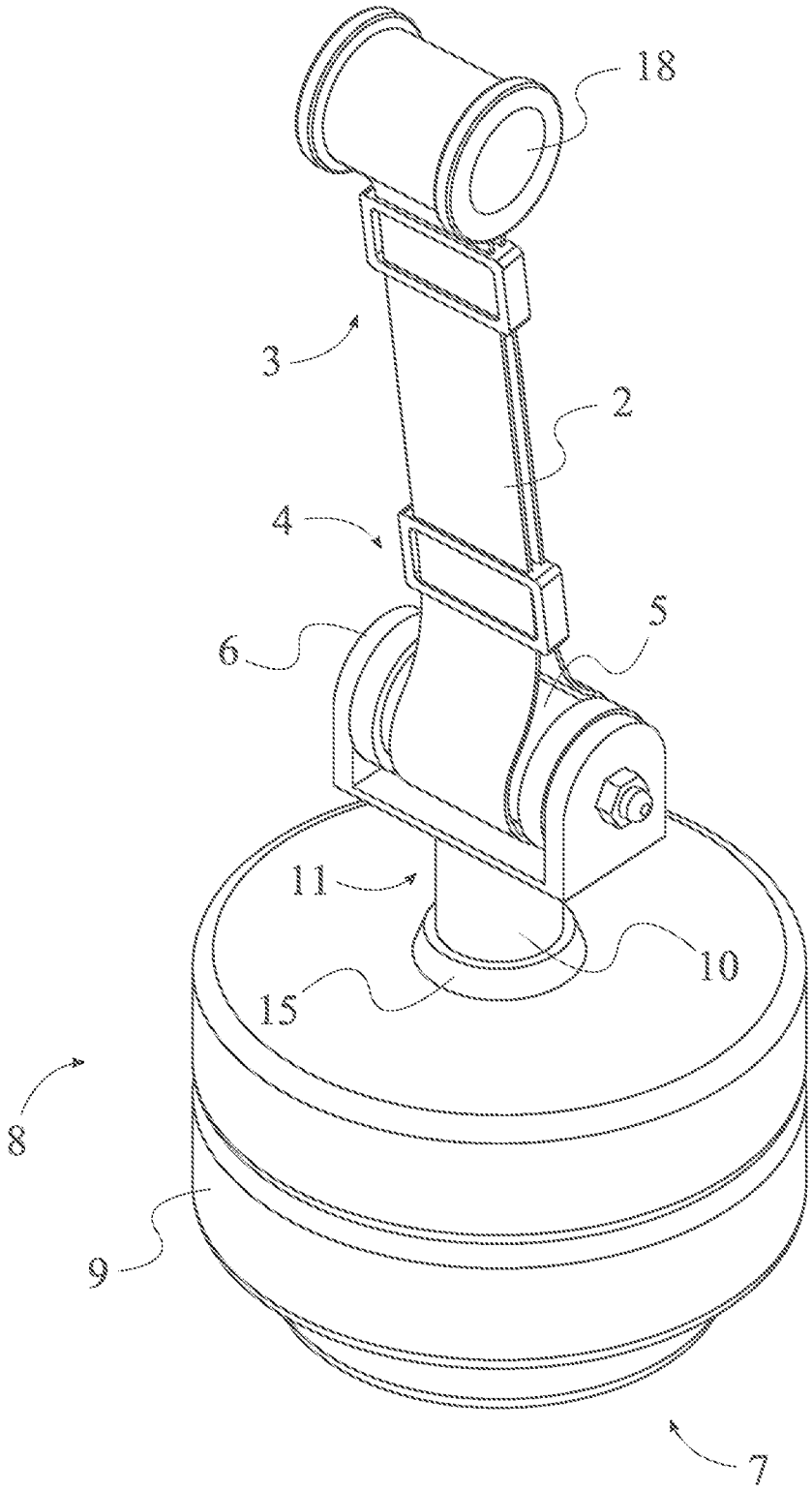
FIG. 3 is a front-top perspective view of a suspended weight of the present invention.

The general configuration of the aforementioned components allows the present invention to efficiently and effectively provide muscular stimulus to a user during exercise. The length-adjustable elastic band 2 comprises a proximal looped end 3 and a distal looped end 4, as shown in FIG. 3. The proximal looped end 3 pertains to the end of the length-adjustable elastic band 2 that preferably interacts with the barbell sleeve, wrapping over the barbell sleeve to effectively attach weight to a barbell. The distal looped end 4 relates to the end of the length-adjustable elastic band 2, opposite the proximal looped end 3, that enables connection to the weight assembly 7. The roller 5 is rotatably mounted into the U-shaped bracket 6. This arrangement allows the roller 5 to rotate relative to the U-shaped bracket 6. The distal looped end 4 is laterally positioned around the roller 5. Thus, the distal looped end 4 is positioned such that shifts in the position or orientation of the length-adjustable elastic band 2 do not affect or strain the transmission of stresses through the U-shaped bracket 6. The weight assembly 7 is mounted adjacent to the U-shaped bracket 6, opposite the roller 5. This arrangement enables the gravitational forces affecting the weight assembly 7 to traverse through the U-shaped bracket 6 and the roller 5 to the length-adjustable elastic band 2, where such forces are preferably transmitted to a barbell sleeve.

Figure 4:
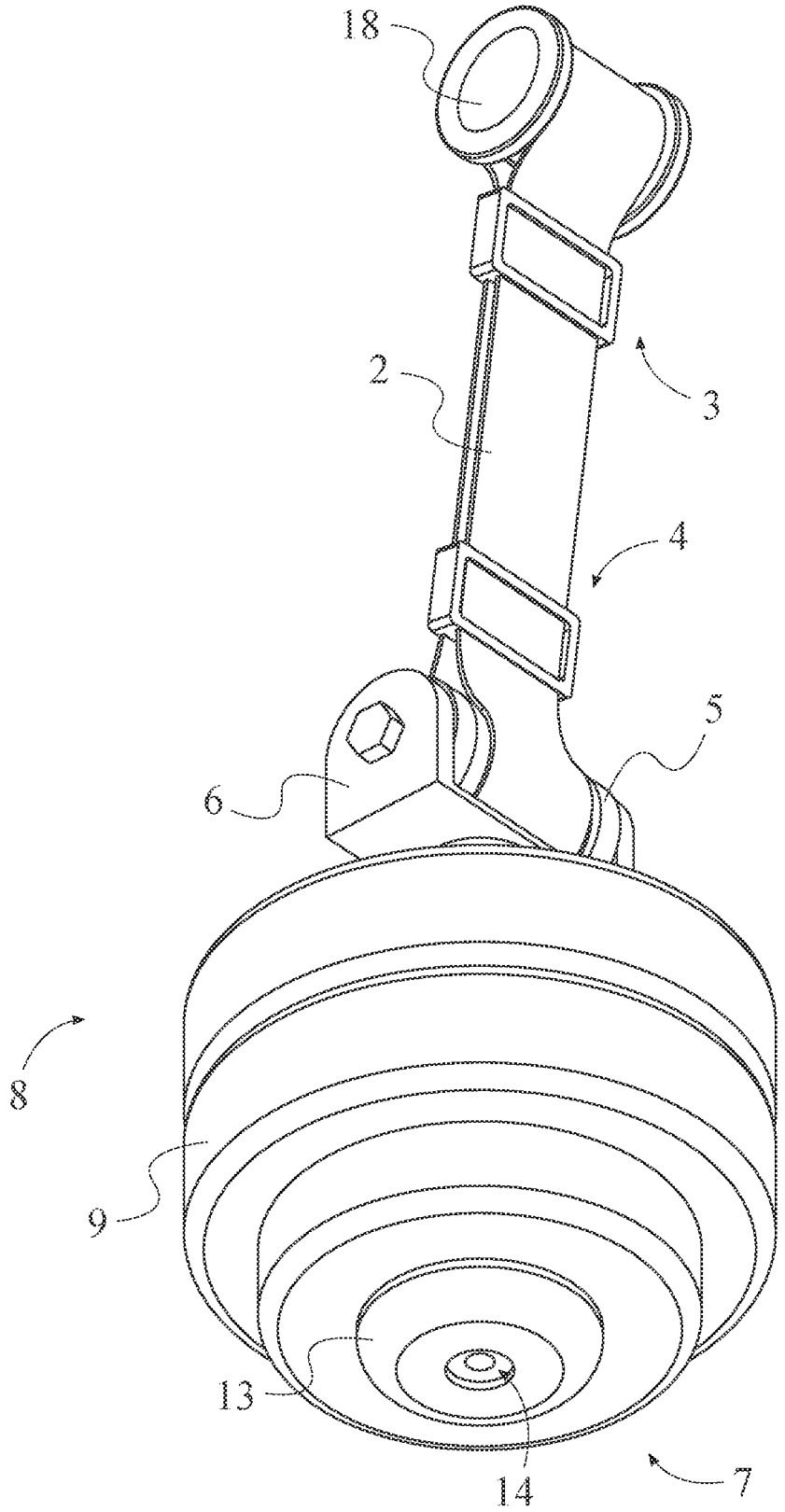
FIG. 4 is a rear-bottom perspective view of a suspended weight of the present invention.

It may be advantageous to provide an alternative mechanism for attaching the plurality of suspended weights 1 to a barbell sleeve. To achieve this end, the present invention may further comprise a barbell-sleeve fastener 18, as shown in FIG. 4. The barbell-sleeve fastener 18 is a generally annular connector that facilitates mounting of the plurality of suspended weights 1 to a barbell sleeve. In an exemplary embodiment, the barbell-sleeve fastener 18 relates to a clamp which fastens around the barbell sleeve to secure the plurality of suspended weights 1 to a barbell. The proximal looped end 3 is laterally positioned around the barbell-sleeve fastener 18. Thus, forces generated from the weight assembly 7 traverse through the barbell-sleeve fastener 18 during use.

Figure 2:
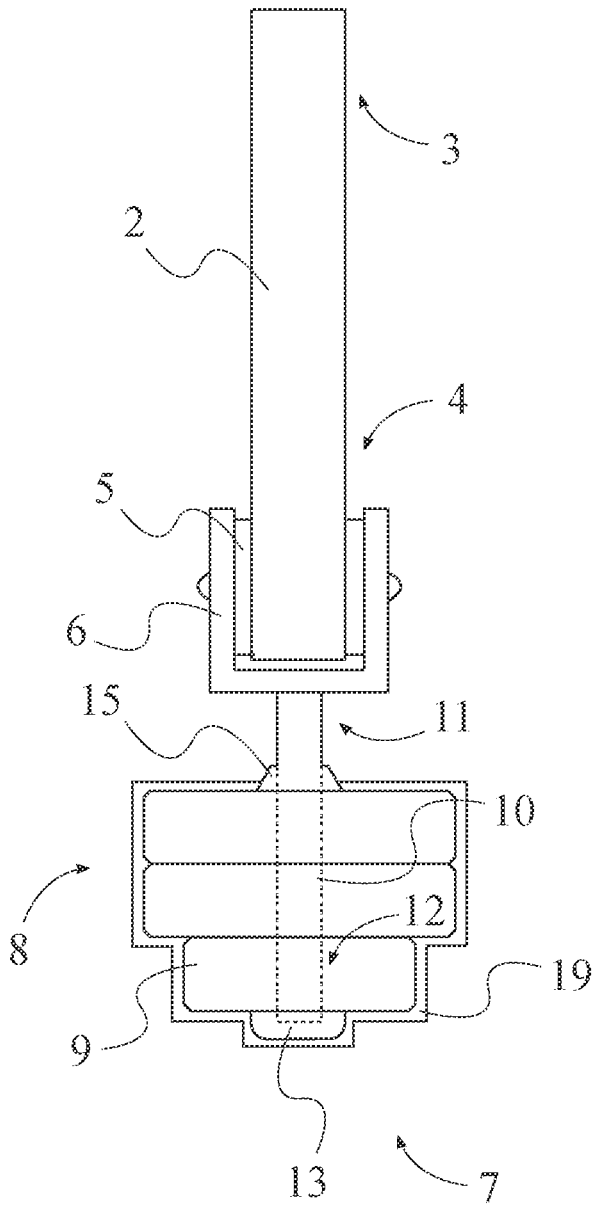
FIG. 2 is a schematic diagram illustrating a suspended weight of the present invention.

Often, the most convenient mechanism for adding weight to the weight assembly 7 requires alignment of multiple weighted plate sets. To this end, the weight assembly 7 may comprise a weight stack 8, a mounting shaft 10, and a mounting head 13, as represented by FIG. 2. The weight stack 8 relates to a set of preferably disk-shaped weighted units positioned concentrically atop each other. The mounting shaft 10 relates to a cylindrical extrusion that enables support and arrangement of heavy weights. The mounting head 13 is a cap that secures weights in position upon the mounting shaft 10. The mounting shaft 10 comprises a proximal shaft end 11 and a distal shaft end 12. The proximal shaft end 11 is the end of the mounting shaft 10 which engages with the U-shaped bracket 6. Conversely, the distal shaft end 12 is the end of the mounting shaft 10 which engages with the mounting head 13. The proximal shaft end 11 is connected adjacent to the U-shaped bracket 6. This arrangement enables transmission of forces from the mounting shaft 10 to the U-shaped bracket 6. The mounting shaft 10 is positioned perpendicular to the roller 5. In this way, forces are applied evenly and equally to the roller 5 through the U-shaped bracket 6. The mounting shaft 10 traverses through the weight stack 8. Thus, the weight stack 8 is secured in position during exercises and use. The mounting head 13 is attached adjacent to the distal shaft end 12. In this way, the mounting head 13 is positioned to transmit weight from the weight stack 8 through the mounting shaft 10.

Furthermore, it is often advantageous to allow the user or a manufacturer to determine the plates contained upon the mounting shaft 10. To enable this, each of the plurality of suspended weights 1 may further comprise a releasable fastener 14, as shown in FIG. 4. The releasable fastener 14 is a connector that secures weights in place relative to the mounting shaft 10. The releasable fastener 14 may connect by a variety of mechanisms, including, but not limited to, threading, latches, notches, buttons, and more. The mounting head 13 is attached adjacent to the distal shaft end 12 by the releasable fastener 14. Thus, the releasable fastener 14 can release to enable modification of the weight stack 8 or can secure the mounting head 13 in place to lock the weight stack 8 for subsequent use.

The present invention further benefits from a fastener positioned opposite the mounting head 13. Providing for this need, each of the plurality of suspended weights 1 may further comprise an annular shoulder 15, as shown in FIG. 3. The annular shoulder 15 relates to a rigid component that secures in position relative to the mounting head 13. The annular shoulder 15 is laterally connected around the mounting shaft 10. Thus, the annular shoulder 15 is positioned to engage evenly with the weight stack 8. The annular shoulder 15 is positioned offset from the distal shaft end 12 along the mounting shaft 10. In this way, the position of the annular shoulder 15 provides ample space for the weight stack 8. The weight stack 8 is pressed in between the annular shoulder 15 and the mounting head 13. Therefore, the weight stack 8 may not move in unexpected ways during exercises and use due to being pinned between the annular shoulder 15 and the mounting head 13.

It is common for weights to assume regular shapes. To this end, the weight stack 8 may comprise at least one annular weight plate 9, as shown in FIG. 3. The at least one annular weight plate 9 may relate to a standard weight plate or may relate to a series of specially made weights adapted for use by the present invention. The mounting shaft 10 is positioned through a center hole of the at least one annular weight plate 9. This arrangement prevents undesirable or uncontrollable lateral movement of the at least one annular weight plate 9 during exercises and use.

In preferred use of the present invention, the weight stack 8 may dangle from the length-adjustable elastic band 2 and may therefore generate undesirable or unexpected swinging motions. To prevent damage due to these motions, each of the plurality of suspended weights may further comprise a rubber coating 19, as represented in FIG. 1. The rubber coating 19 relates to a film or layer of vulcanized polymeric material capable of absorbing and dispersing impact forces due to collisions of the weight stack 8 with various objects. The weight stack 8 is enclosed by the rubber coating 19. This arrangement prevents the weight stack 8 from causing unintentional harm to the weight stack 8 itself, as well as to nearby objects, items, or equipment.

Figure 5:
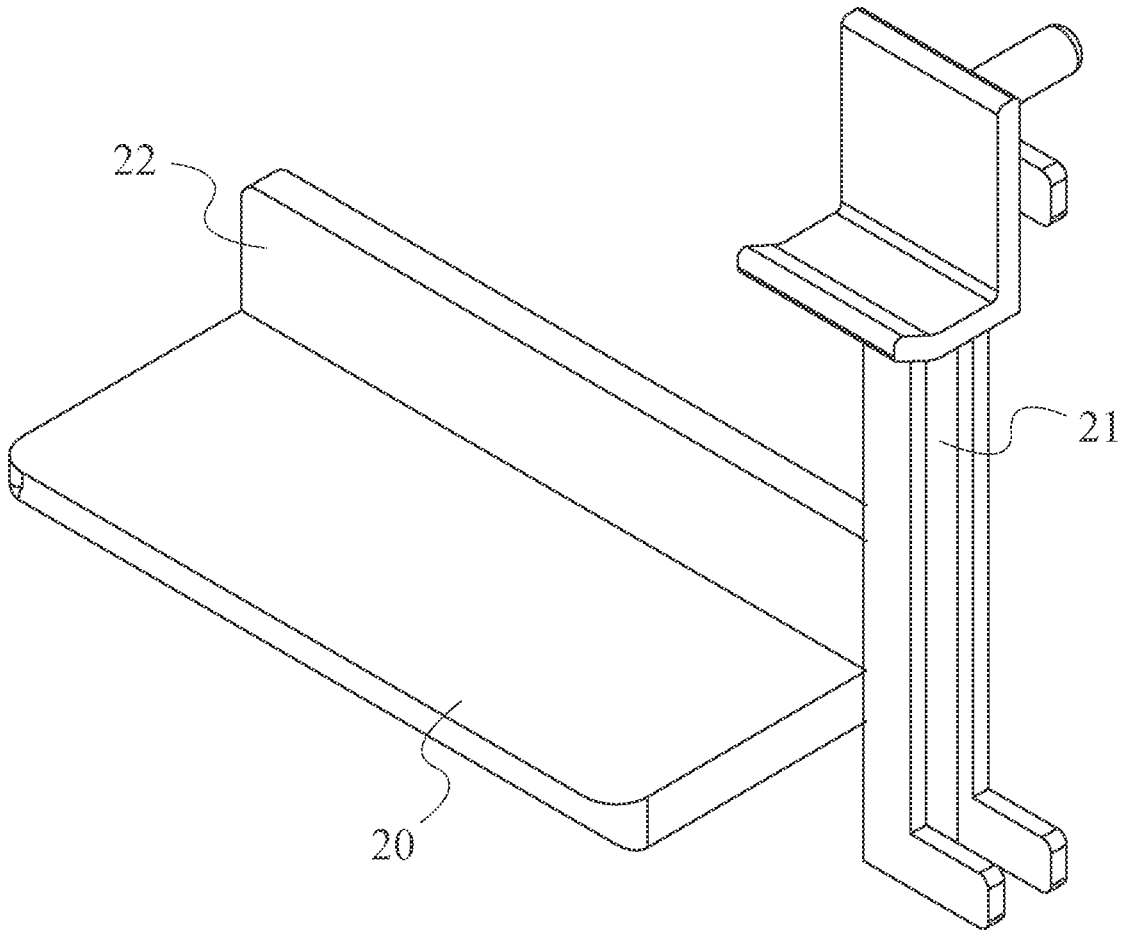
FIG. 5 is a front-top perspective view of a first rest platform of the present invention.

In order to perform the desired exercise movements, the user benefits from features that enhance the ability of the length-adjustable elastic band 2 to mount to a barbell sleeve. To accommodate this desire, the present invention may further comprise a first rest platform 20 and a first rack adapter 21, as shown in FIG. 5. The first rest platform 20 relates to a flat support arranged generally beneath the plurality of suspended weights 1 on one side of a standard weight rack. The first rack adapter 21 relates to an apparatus designed to connect to the standard weight rack or power rack. In an exemplary embodiment, the first rack adapter 21 may further include a J-hook to provide the user with a convenient location to rerack weights upon completion of an exercise set. Moreover, the plurality of suspended weights 1 may comprise a first set of suspended weights 16. The first set of suspended weights 16 relates to the plurality of suspended weights 1 which interact with one side of a barbell for the standard weight rack or power rack. The first rack adapter 21 is peripherally connected to the first rest platform 20. In the preferred usage of the present invention, this arrangement enables the first rest platform 20 to extend into advantageous position generally away from the standard weight or power rack. The weight assembly 7 from each of the first set of suspended weights 16 is situated onto the first rest platform 20. Thus, the user may rest the weight assembly 7 between exercise sets, either for rest time or to modify the weight assembly 7.

Figure 6:
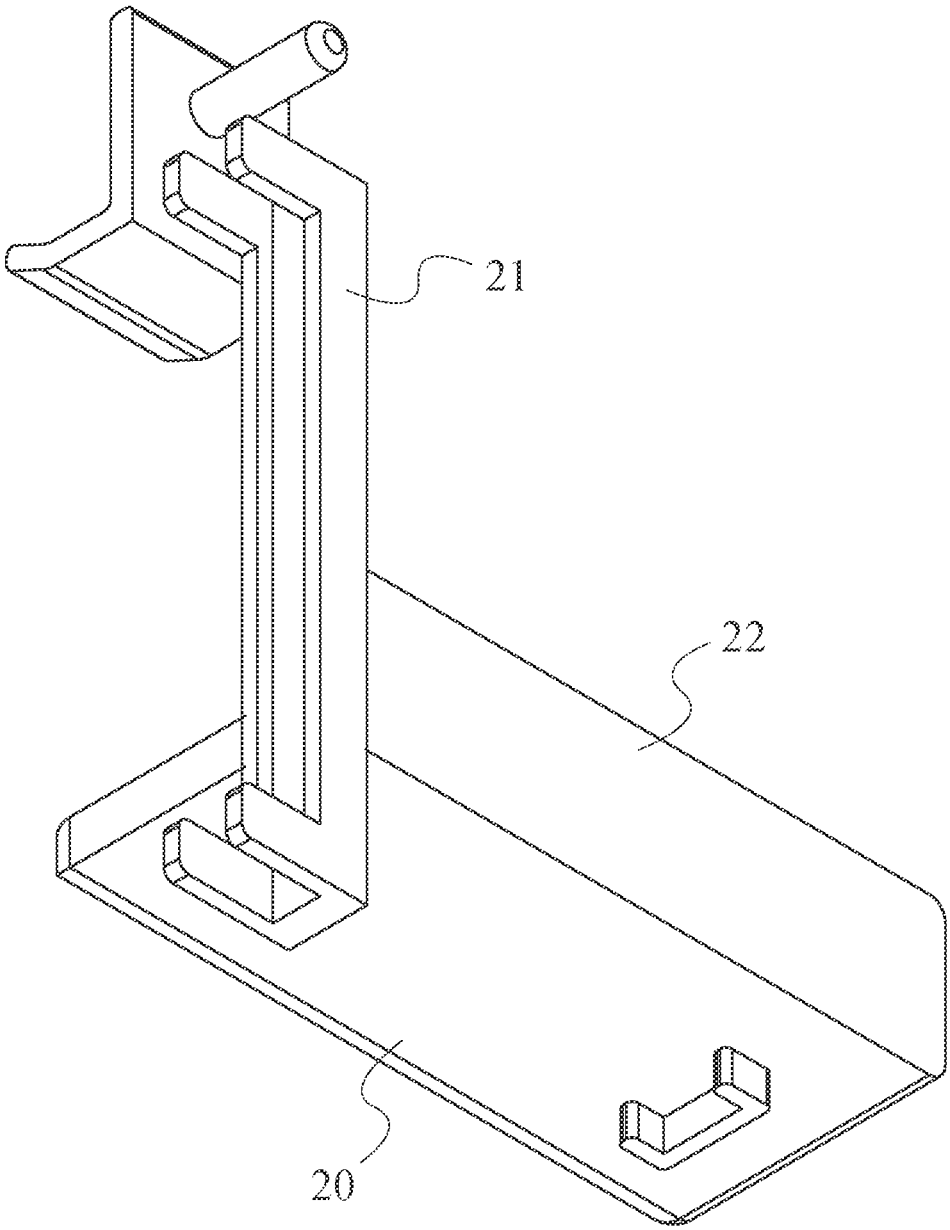
FIG. 6 is a rear-bottom perspective view of a first rest platform of the present invention.

The first rest platform 20 benefits from the addition of boundaries that assist the user in correctly and safely arranging the weight assembly 7 upon the first rest platform 20. To achieve this, the present invention may further comprise a first backing plate 22, as shown in FIG. 6. The first backing plate 22 is a generally flat body that prevents the weight assembly 7 from swinging beyond the limits of the first rest platform 20 during use. The first backing plate 22 is perpendicularly connected onto the first rest platform 20. This arrangement provides the rigid boundary preventing the weight assembly 7 from swinging excessively during racking of the weight assembly 7. The first backing plate 22 is peripherally positioned to the first rest platform 20. This arrangement maximizes the surface area available for interaction between the first rest platform 20 and the weight assembly 7 while still providing a stop for the weight assembly 7 with the first backing plate 22 at the edge of the first rest platform 20.

Figure 7:
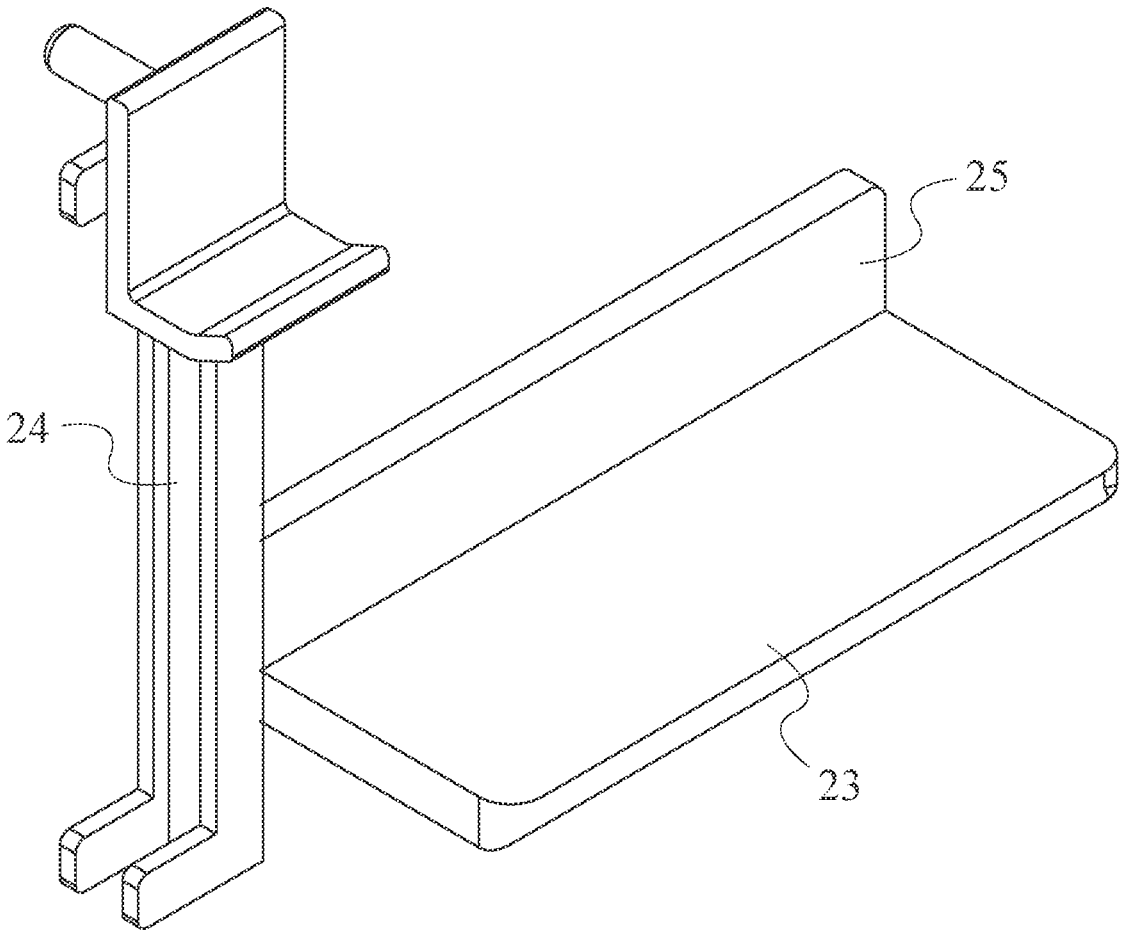
FIG. 7 is a front-top side view of a second rest platform of the present invention.

Similarly, the opposite end of the barbell must be equipped with components to help manage the position of the weight assembly 7. To accommodate this desire, the present invention may further comprise a second rest platform 23 and a second rack adapter 24, as shown in FIG. 7. The second rest platform 23 relates to a flat support arranged generally beneath the plurality of suspended weights 1 on the other side of the standard weight rack or power rack. The second rack adapter 24 relates to an apparatus designed to connect to the standard weight rack or power rack. In an exemplary embodiment, the second rack adapter 24 may further include a J-hook to provide the user with a convenient location to rerack weights upon completion of an exercise set. Moreover, the plurality of suspended weights 1 comprises a second set of suspended weights 17. The second set of suspended weights 17 relates to the plurality of suspended weights 1 which interact with the other side of a barbell for the standard weight rack or power rack. The second rack adapter 24 is peripherally connected to the second rest platform 23. In the preferred usage of the present invention, this arrangement enables the second rest platform 23 to extend into advantageous position generally away from the standard weight or power rack. The weight assembly 7 from each of the second set of suspended weights 17 is situated onto the second rest platform 23. Thus, the user may rest the weight assembly 7 between exercise sets, either for rest time or to modify the weight assembly 7.

Figure 8:
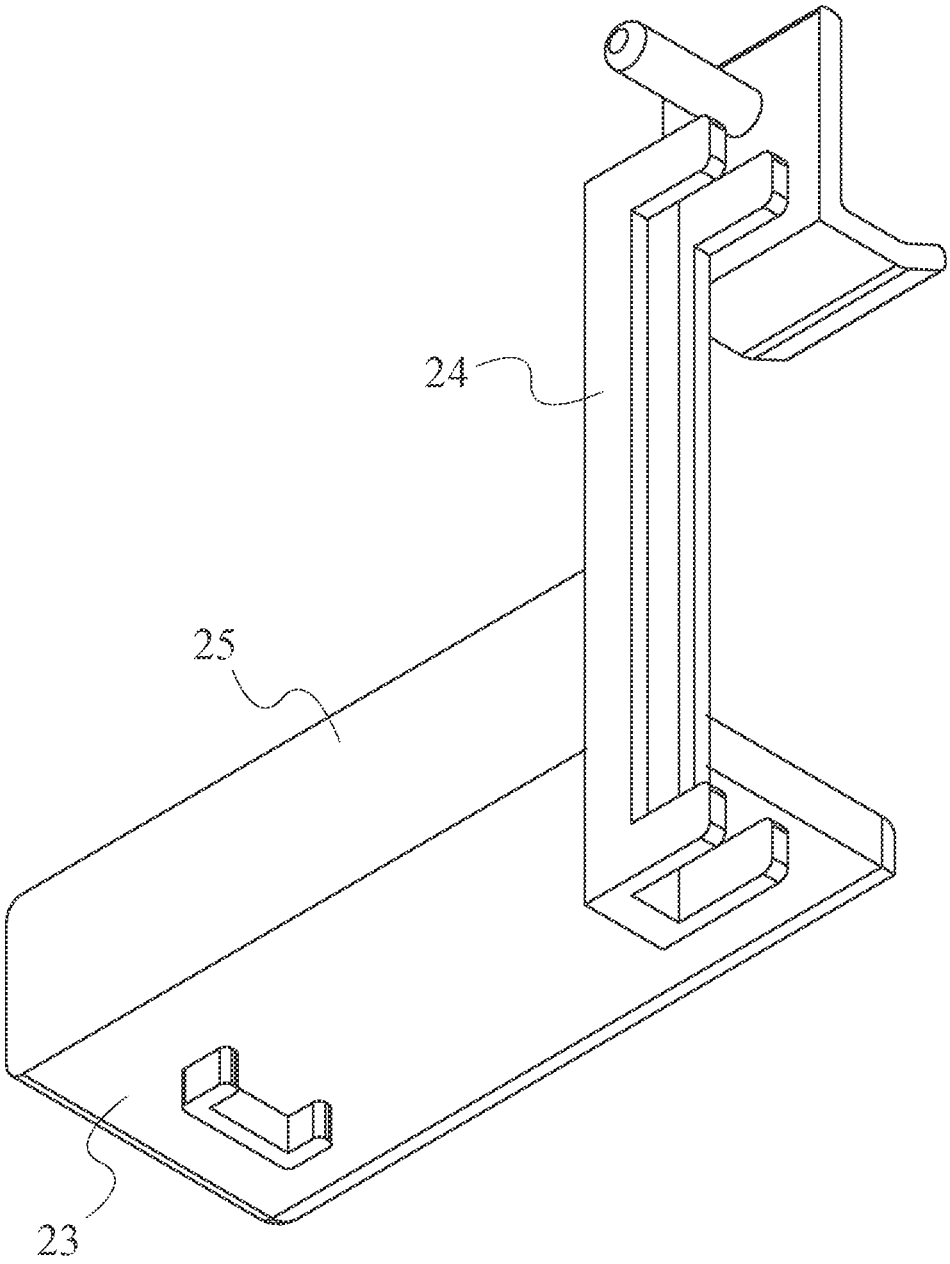
FIG. 8 is a rear-bottom perspective view of a second rest platform of the present invention.

The second rest platform 23 benefits from the addition of boundaries that assist the user in correctly and safely arranging the weight assembly 7 upon the second rest platform 23. To achieve this, the present invention may further comprise a second backing plate 25, as shown in FIG. 8. The second backing plate 25 is a generally flat body that prevents the weight assembly 7 from swinging beyond the limits of the second rest platform 23 during use. The second backing plate 25 is perpendicularly connected onto the second rest platform 23. This arrangement provides the rigid boundary preventing the weight assembly 7 from swinging excessively during racking of the weight assembly 7. The second backing plate 25 is peripherally positioned to the second rest platform 23. This arrangement maximizes the surface area available for interaction between the second rest platform 23 and the weight assembly 7 while still providing a stop for the weight assembly 7 with the second hacking plate 25 at the edge of the second rest platform 25.

It is often helpful to include mechanisms to assist with securing the proximal looped end 3 in place about a barbell sleeve. In an exemplary embodiment, the present invention may further utilize a sleeve adapter. The sleeve adapter relates to a rigid unit which secures to a standard barbell sleeve to assist in positioning of the proximal looped end 3 upon a barbell sleeve to prevent sliding during exercises. The sleeve adapter may further utilize a plurality of channels to prevent the length-adjustable elastic band 2 from sliding along the barbell sleeve. The plurality of channels is a set of annular cuts around the sleeve adapter which enhance the ability of the sleeve adapter to retain the proximal looped end 3 during use. The present invention preferably includes two sleeve adapters, which are used on opposing ends of a barbell.

Although the invention has been explained in relation to its preferred embodiment, it is to be understood that many other possible modifications and variations can be made without departing from the spirit and scope of the invention as hereinafter claimed.

What is claimed is:

1. A weightlifting system for hanging band technique comprising:

a weight;

the weight comprising a length-adjustable elastic band, a roller, a U-shaped bracket and a weight assembly;

the length-adjustable elastic band comprising a proximal looped end and a distal looped end;

the roller being rotatably mounted into the U-shaped bracket;

the distal looped end being laterally positioned around the roller; and the weight assembly being mounted adjacent to the U-shaped bracket, opposite the roller.

2. The weightlifting system for hanging band technique as claimed in claim 1 further comprising:

the weight assembly comprising a weight stack, a mounting shaft and a mounting head;

the mounting shaft comprising a proximal shaft end and a distal shaft end;

the proximal shaft end being connected adjacent to the U-shaped bracket;

the mounting shaft being positioned perpendicular to the roller;

the mounting shaft traversing through the weight stack; and the mounting head being attached adjacent to the distal shaft end.

3. The weightlifting system for hanging band technique as claimed in claim 2 further comprising:

the weight further comprising a releasable fastener; and the mounting head being attached adjacent to the distal shaft end by the releasable fastener.

4. The weightlifting system for hanging band technique as claimed in claim 2 further comprising:

the weight further comprising an annular shoulder;

the annular shoulder being laterally connected around the mounting shaft;

the annular shoulder being positioned offset from the distal shaft end along the mounting shaft; and the weight stack being pressed in between the annular shoulder and the mounting head.

5. The weightlifting system for hanging band technique as claimed in claim 2 comprises further comprising:

the weight stack comprising at least one annular weight plate; and the mounting shaft being positioned through a center hole of the at least one annular weight plate.

6. The weightlifting system for hanging band technique as claimed in claim 2 further comprising:

the weight further comprising a rubber coating; and the weight stack being enclosed by the rubber coating.

7. The weightlifting system for hanging band technique as claimed in claim 1 further comprising:

a rest platform;

a rack adapter;

the rack adapter being peripherally connected to the rest platform; and the weight assembly being situated onto the rest platform.

8. The weightlifting system for hanging band technique as claimed in claim 7 further comprises:

a backing plate;

the backing plate being perpendicularly connected onto the rest platform; and the backing plate being peripherally positioned to the rest platform.

9. The weightlifting system for hanging band technique as claimed in claim 1 further comprising:

a barbell-sleeve fastener; and the proximal looped end being laterally positioned around the barbell-sleeve fastener.

* * * * *